US006817798B2

(12) United States Patent
Kugler et al.

(10) Patent No.: US 6,817,798 B2
(45) Date of Patent: Nov. 16, 2004

(54) METHOD AND APPARATUS FOR APPLYING MASTIC OR GRANULAR MATERIAL TO A ROOFING SURFACE

(76) Inventors: William E. Kugler, 2989 S. Detroit Way, Denver, CO (US) 80210; Stephen J. Knight, III, 4520 W. Wagontrail Dr., Littleton, CO (US) 80123

( * ) Notice: Subject to any disclaimer, the term of this patent is extended or adjusted under 35 U.S.C. 154(b) by 0 days.

(21) Appl. No.: 10/364,708

(22) Filed: Feb. 10, 2003

(65) Prior Publication Data

US 2003/0129011 A1 Jul. 10, 2003

Related U.S. Application Data

(63) Continuation-in-part of application No. 09/952,977, filed on Sep. 14, 2001, now Pat. No. 6,540,423.

(51) Int. Cl.[7] ..... A46B 11/00; B05C 11/02
(52) U.S. Cl. ..... 401/48; 118/108; 118/207
(58) Field of Search ..... 118/48, 188 R, 118/108, 207, 305; 401/188 R, 48, 118, 140, 261; 417/234, 229

(56) References Cited

U.S. PATENT DOCUMENTS

| | | | | |
|---|---|---|---|---|
| 3,208,094 A | | 9/1965 | Pilkington | 15/546 |
| 4,055,384 A | | 10/1977 | Palzer | 401/48 |
| 4,893,751 A | * | 1/1990 | Armstrong | 239/150 |
| 5,358,347 A | | 10/1994 | Morris | 401/48 |
| 5,366,309 A | | 11/1994 | Springall | 401/48 |
| 5,419,647 A | | 5/1995 | Kirk et al. | 401/48 |
| 5,552,014 A | | 9/1996 | Morris | 156/577 |
| 5,600,929 A | | 2/1997 | Morris | 52/309.8 |
| 6,102,615 A | | 8/2000 | Wilson, Sr. | 404/111 |
| 6,183,156 B1 | | 2/2001 | Morris | 401/282 |
| 6,540,423 B1 | | 4/2003 | Kugler et al. | 401/48 |

* cited by examiner

*Primary Examiner*—David J. Walczak
(74) *Attorney, Agent, or Firm*—Sheridan Ross P.C.

(57) ABSTRACT

A portable apparatus adapted for applying an adhesive and mastic roofing material is provided which allows one operator to use smaller, more maneuverable containers of roofing mastic for use in applying roofing materials and adhesives to roofing surfaces. In one embodiment a movable platform is provided wherein the internal pressure of the container is increased wherein less pump energy is required to achieve sufficient adhesive coverage.

25 Claims, 10 Drawing Sheets

METHOD AND APPARATUS FOR APPLYING MASTIC OR GRANULAR MATERIAL TO A ROOFING SURFACE

This application is a Continuation-In-Part of U.S. patent application Ser. No. 09/952,977, filed Sep. 14, 2001, now U.S. Pat. No. 6,540,423, entitled "METHOD AND APPARATUS FOR APPLYING MASTIC OR GRANULAR MATERIAL TO A ROOFING SURFACE" which is incorporated herein by reference in its entirety.

FIELD OF THE INVENTION

The present invention relates to portable self contained apparatus used for the application of bulk adhesive mastic material and roofing materials associated therein.

BACKGROUND OF THE INVENTION

Roofing materials have been used for centuries to adequately seal a roof structure to prevent the encroachment of water and other elements. These materials have developed over time from straw, thatch and mud type roofs to shingles and roofing felt, along with metal roofs and composite materials such as tile. These materials are all designed to provide a cost effective method of sealing a roofing structure from the elements to prevent inherent damage to the building structure and provide a dry, comfortable living or working environment for the occupants of the structure.

One type of roof commonly used is comprised of roofing material with embedded adhesive material therein. As the roofing material is rolled into place a plurality of propane-fueled flames are employed to heat the embedded adhesive. This type of operation has proven potentially dangerous to the laborers and underlying structure.

Another type of roof commonly used in the commercial roofing industry is a composite roof which utilizes a felt or composite roofing material applied over the roof's structural surface and secured with an unheated viscous adhesive material such as roofing mastic. The roofing mastic serves to adhere the felt roofing material to the top of the roof structure. Once the felt or other impermeable material is in place, mineral granules or gravel or other similar materials are often applied on top of the completed roofing membrane for protection from the ultraviolet rays of the sun, hail, snow and other environmental conditions.

One significant problem which exists during commercial roofing operations is the application of the adhesive mastic material to a roofing surface, which requires significant volumes of mastic material to be applied to the roofing surface. To accommodate transporting the adhesive mastic material from the ground level to the roofing surface, large cranes and/or self contained truck pumping units are required which are expensive and require a significant capital investment and trained manpower to operate. These self contained units typically weigh thousands of pounds and hold hundreds of gallons of mastic material in one or more compartments. Further, the pumping equipment necessary to pump high volumes of extremely viscous mastic material from a street level to a roofing surface is significant, and the horse power required and fuel associated therein is not cost effective for smaller roofing surfaces. One such apparatus is described in U.S. Pat. No. 5,358,347 to Morris, which discloses a roof mastic applicator which is used in connection with a large reservoir positioned on the ground level and interconnected to a larger pump and associated truck to transport the mastic material to a roofing surface.

Accordingly, a significant need exists for a portable mastic application apparatus which may be operated by one laborer and which can be used in conjunction with smaller mastic containers such as five gallon containers which can be transported quickly and easily without the necessity of heavy pumping equipment and trucks. There is an additional need for a system and method for applying the adhesive mastic material to a roofing surface while simultaneously applying the bulk felt roofing material on top of the mastic material at the same time, thus saving significant time and expense. Finally, there is an additional need for an apparatus which can simultaneously apply the roofing mastic material and/or a bulk granular material such as mineral granules, at the same time. Accordingly, an apparatus and associated method which are designed to address these problems are provided herein as set forth below.

SUMMARY OF THE INVENTION

It is thus one aspect of the present invention to provide a self contained, portable pumping apparatus which is adapted to apply an adhesive mastic material to a roofing surface, and which can be operated by one laborer. Alternatively, the apparatus may be used to apply sealing or other materials to asphalt driveways, parking lots and other surfaces. Thus, in one embodiment of the present invention, a hand cart is provided which is controlled by one laborer and which supports a small container of mastic material and an associated pump, which is connected to a discharge manifold. The discharge manifold is designed to selectively apply a predetermined volume of mastic material to a roofing surface, the thickness of which can be controlled by the speed of operation of the self-contained unit. The mastic material is generally stored in a small container such as a 5–10 gallon pail which can easily be transported by one or two laborers to a roofing surface, as opposed to requiring a large pumping unit positioned on the ground level or the lifting of a large bulk container with a crane or other similar device.

It is another aspect of the present invention to provide a spreading mechanism which applies a consistent thickness of mastic material on the roofing surface. Thus in one embodiment of the present invention a spreader bar is interconnected to the discharge manifold in a downstream position and which simultaneously spreads the mastic material on the roofing surface as it is discharged from discharge ports or a plurality of valves. In a further embodiment of the present invention, an oscillating motion may be applied to the spreader bar which enhances the uniform application of the mastic material to the roofing surface. In addition, the spreading mechanism in one embodiment is capable of articulation, and thus adapted for use on undulating surfaces.

It is yet another aspect of the present invention to provide a portable pumping unit which can be controlled from pneumatic compressed air or other readily available power sources common to the construction industry. Thus in other embodiments of the present invention a small gas operated pump may be used or an electric pump with sufficient horsepower to pump a viscous mastic material from a container through a discharge manifold on to a roofing surface. As discussed herein, the term "adhesive mastic" applies to all types of viscous, adhesive materials commonly used in the construction and roofing trades, as well as sealants for asphalt driveways and other surfaces. One example of such a material is an asphaltic modified bitumen adhesive such as modified bitumen adhesive (MBR) which is manufactured and sold by the Johns Manville® Companies.

It is another aspect of the present invention to provide a device which can apply a mastic material and a bulk roofing material such as rolled felt simultaneously. Thus, in one embodiment of the present invention a support member is operably interconnected to the frame of the portable apparatus and which extends outwardly in a position immediately downstream from the discharge manifold. As the adhesive mastic is selectively applied to the roofing surface, the bulk roofing material may be rolled on to the roofing surface simultaneously, yet requiring only one laborer to operate the machine. This technique, known commonly as cold adhesion, provides an additional seal and omits the need for propane-fed flames to heat the roofing material in order to melt and liquify entrained bonding material. In addition, less cost and heightened safety and comfort are realized due to the omission of propane and an open flame.

In a further aspect of the present invention, a bulk discharge container may be mounted downstream of the discharge manifold, and which applies a bulk granular material such as mineral granules or gravel. Thus, in one embodiment of the present invention the support member may be used to hold a container similar to a fertilizer spreader and which can hold between five and fifty pounds of mineral granules or pea gravel, or other similar materials which can be selectively dispensed on top of the mastic in applications where a felt roofing material or other similar materials are not used, or used in combination therein. Alternatively, the granular materials could be dispensed independently with the same portable machine and without applying the mastic material.

It is yet another aspect of the present invention that the portable apparatus be self propelled to assist the operator. In one embodiment of the present invention, a small motor may be used with associated gears, chains or belts interconnected to the wheels to provide a constant speed of travel, and to reduce the fatigue associated with operating the machine on a hot roofing surface.

It is yet another aspect of the present invention to provide a hand held wand which may be interconnected to the discharge end of the pump in combination with the discharge manifold. In this application, an operator may selectively operate the handheld wand to provide a single, selective bead or spray of mastic material along the lap edge of roll roofing in a predetermined location, without utilizing the discharge manifold and associated dispensing ports. In this embodiment, the handheld wand may have a trigger mechanism or other similar apparatus which is used by the operator to selectively control the volume of mastic dispensed from the wand.

It is yet another aspect of the present invention to provide a separate manifold that can apply a continuous bead of roofing insulation adhesive to and along the top flanges of a structured steel roof deck so to apply the viscous adhesive in ribbons on varying and selective locations and varying rates and locations for the purpose of installing preformed roof insulation boards.

It is another aspect of the present invention to provide a pressure enhancement mechanism, thereby decreasing the amount of pressure generation required from the pump. In one embodiment of the present invention a movable platform is provided which is capable of displacing the container relative to a sealing inductor plate. More specifically, a container containing mastic material is placed on the platform which is interconnected to at least one pneumatically driven piston. The sealing inductor plate is adapted with an aperture for the pump interface and is installed on the open container. Pressure imparted on the piston causes the platform to move relative to the sealing inductor plate, thereby increasing the internal pressure of the container to a predetermined amount, in one embodiment to at least about 20 to 40 psi, which assists the pump in its task of transporting the mastic material from the container to the pump suction and discharge manifold. In one embodiment of the present invention the platform is capable of traveling at least about 18 to 24 inches. Since the pressure requirements of the pump are reduced, in one embodiment by at least about 50 percent a smaller, lighter, and less-expensive pump and compressor may be used to achieve the same result as other alternative embodiments. For example, a pump of one embodiment of the present invention is capable of transferring mastic material with a viscosity of at least about 100.000 centinoise at a rate of at least 3 gallons per minute when the ambient temperature is about 50° F.

It is still yet another aspect of the present invention to provide performance control and monitoring mechanisms to aid a user in applying adhesive material as described herein. One embodiment of the present invention employs a pressure activated piston to operably engage and disengage, either together or separately, the aforementioned spreading mechanism and discharge manifold. More specifically, a user interface is provided that is capable of altering the vertical placement of the spreading mechanism wherein the pressure applied by the piston can be proportionally altered to accommodate varying thickness of mastic material. An additional user interface may also be employed which regulates the stroke and positioning of the platform with respect to the inductor plate, and wherein the internal pressure of the container will be selectively adjusted. It is also an aspect of the present invention to provide a plurality of gauges or other means wherein the user is able to monitor operational performance such as internal container pressure, spreading mechanism pressure, spreading mechanism location, pump pressure, platform location, or mastic material quantity.

It is another aspect of the present invention to provide a discharge manifold equipped with a plurality of output mechanisms. Preferably, output nozzles are used which are further equipped with valves such that the user can selectively activate and deactivate the individual output streams to tailor the mastic application for a given task. For example, the application area may call for a right or left biased mastic deposition wherein the user would deactivate the un-required nozzles. Alternatively, a discharge manifold tailored for a specific task may be employed. For example, a plurality of discharge locations may be matched to the top flange spacing of a steel roof deck so that adhesive is only applied where required.

It is another aspect of the present invention to provide an application apparatus that is easy to deploy and operate. In one embodiment of the present invention lifting fixtures are employed to the apparatus wherein one or two laborers would be capable of hoisting the apparatus onto an application area such as a roof. In addition, the apparatus is easily controlled by one user wherein a second laborer may be employed to aid in exchanging the container or adding rolls of roofing material for example, thereby reducing total task completion time. Alternatively, a single user could conceivably perform all tasks which would also reduce cost.

Thus, in one aspect of the present invention, a portable apparatus which is adapted for applying an adhesive mastic and roofing material is provided herein, and which comprises:

a frame;

at least one wheel rotatably interconnected to said frame;

a platform interconnected to said frame which is adapted for supporting a container of the liquid material;

a pump interconnected to said frame and comprising a suction end and a discharge end, said suction end operably positioned to communicate with the liquid material;

a container induction plate interconnected proximate to said suction end of said pump for sealingly engaging an open end of the container;

a discharge manifold in operable communication with said discharge end of said pump;

at least one dispensing port in communication with said discharge manifold for discharging the liquid material onto a treatment surface; and a platform lifting means, wherein said platform travels between a first lowered position and a second raised position while said inductor plate is maintained in a substantially static position, wherein a pressure is applied to the liquid material in the container.

DETAILED DESCRIPTION

Figure 1:
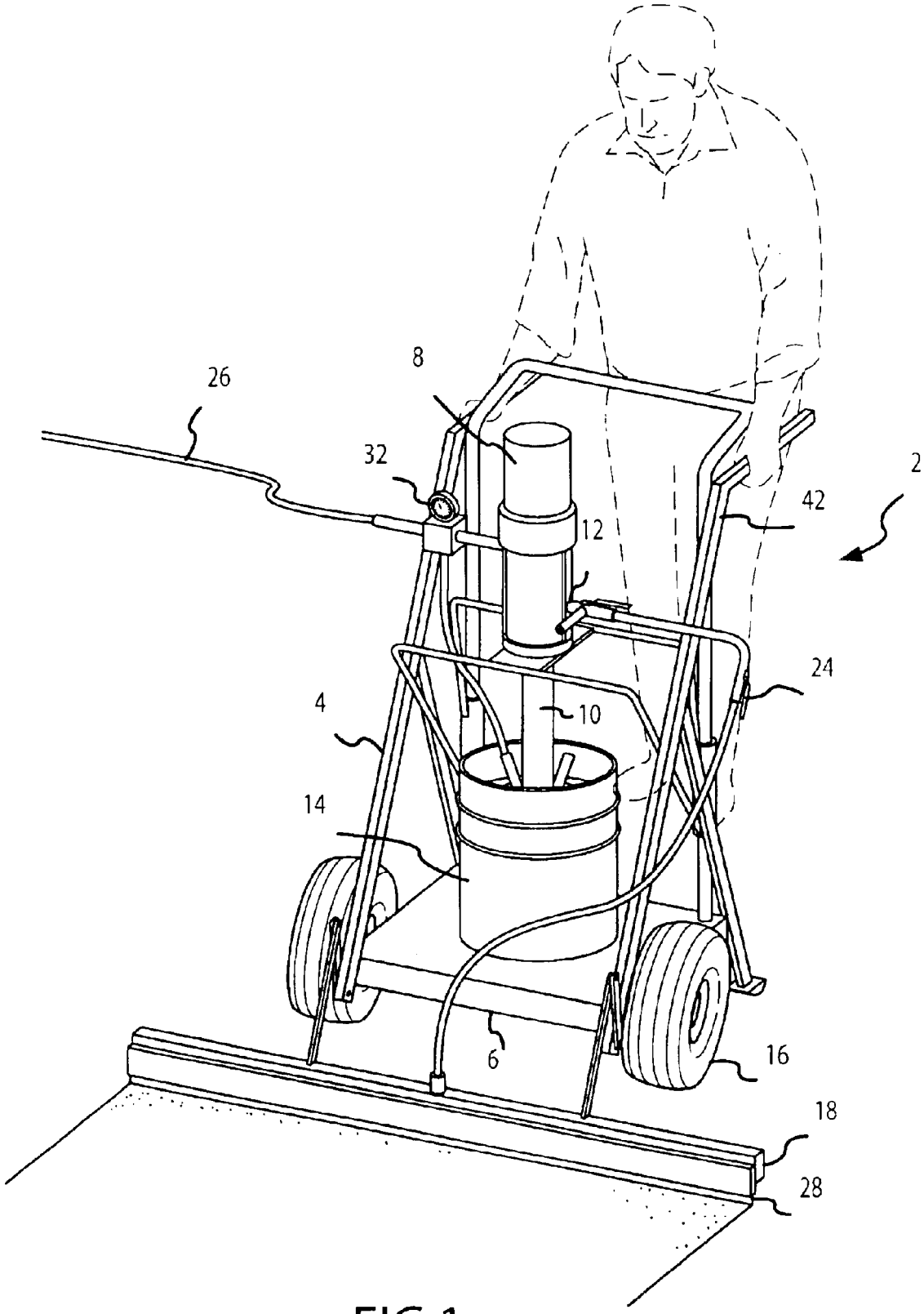
FIG. 1 is a front perspective view of the present invention in use.

Referring now to the drawings, FIGS. 1–7 are provided herein to more accurately describe the present invention and the components associated therein. More specifically a material applicator 2 is provided which employs a pump 8 which is capable of displacing a liquid or viscous adhesive material from a container 14 to a discharge manifold 18. The discharge manifold 18 is equipped with a plurality of discharge ports 20 which deposit the adhesive material.

Referring now to FIG. 1, a front perspective view of the present invention is provided and which generally shows the numerous components of the device and the position of an operator during use. More specifically, the portable mastic applicator 2 is generally comprised of a frame 4 which is typically constructed of a metal or other substantially rigid material and which has a platform 6 interconnected on a lower end. The substantially planar platform 6 is designed to support an adhesive container 14 such as a five gallon pail or other portable device. The adhesive container 14 is operably positioned below a pump 8, which is driven by pneumatic pressure in one embodiment, and thus interconnected to a pneumatic injection line 26. For operational purposes, a compressor (not shown) is used to provide the compressed air for the pneumatic injection line 26. Alternatively, the pump may be driven by a gas or electric powered motion.

As discussed herein, the term "adhesive mastic" refers to any type of viscous material such as glues, adhesions, coatings, paints, sealants and other similar materials which may be applied in bulk. Thus, it is anticipated that the present invention may be utilized to disperse materials having a viscosity of between about 120,000 centipoise ("cp") and 10,000 cp at a temperature of between about 40° F. and 100° F. For applications in the roofing industry, mastic materials such as MBR adhesive and Permastic adhesive may be dispensed from the apparatus, and which generally have a viscosity of between about 11,000 cp and 20,000 cp.

The discharge port 20 or dispensing channel preferably has a cross-sectional area of at least about 0.3 $in^2$ to provide a sufficient opening to dispense an adequate amount of adhesive mastic material. In a typical application, the mastic material is applied to a thickness of between about ⅙ inches and ⅛ inches to the roofing surface. Thus, the pump 8 of the present invention is typically required to provide a discharge rate of preferably at least about 1 to 2½ gallons per minute (gpm) to provide a sufficient amount of adhesive mastic through the discharge port, which preferably has a length of between 24 inches and 60 inches.

The pump 8 generally has a pump suction end 10, which is in operable communication with the mastic material contained in the adhesive container 14. The pump 8 further comprises a pump discharge end 12 which is interconnected to a downstream line for transporting the mastic material to a discharge manifold 18. This line may be comprised of screwed metallic pipe and/or high pressure pneumatic line which is commonly known in the art. To selectively interrupt communication from the pump discharge end 12 to the discharge manifold 18, one or more valves 24 are provided as shown.

Furthermore, although in a preferred embodiment the pump 8 is positioned above the mastic container 14, it is feasible that the pump could be positioned below the platform 6 and associated mastic container 14. Thus, the respective positioning of the pump 8 and mastic container 14 is not critical to the present invention as long as there is communication between the mastic container 14 and the pump suction 10.

Figure 2:
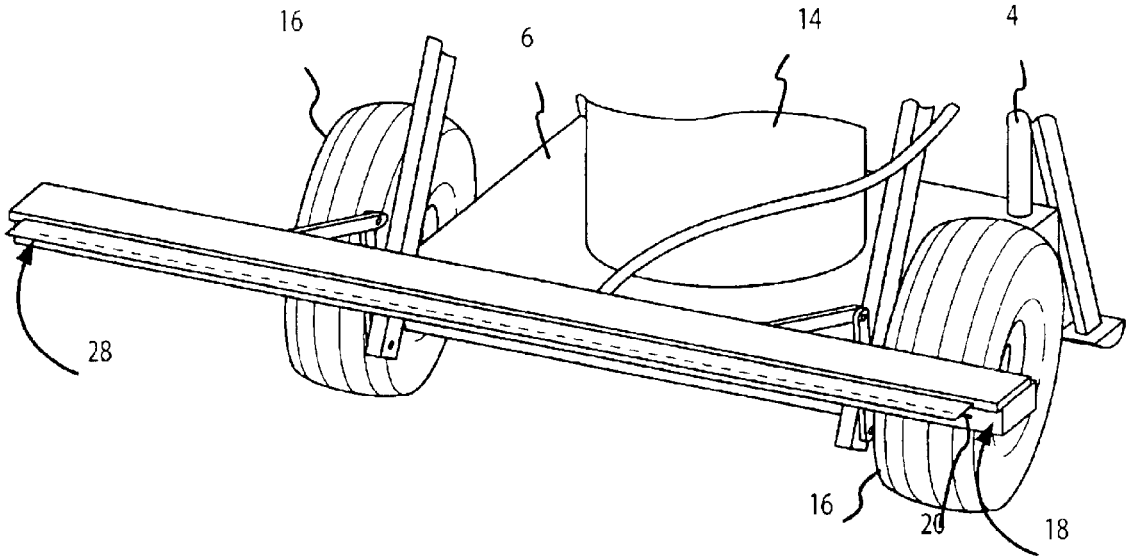
FIG. 2 is a front perspective view of the invention shown in FIG. 1 and providing more detail with regard to a discharge manifold and spreader mechanism.

Positioned on the distal end of the discharge line, a discharge manifold is provided and is shown in greater detail in FIG. 2. The discharge manifold 18 in one embodiment comprises a metallic pipe or rectangular shaped mechanism with one or more dispensing ports 20 which extend substantially from one end of the discharge manifold 18 to the opposing end. Alternatively, one or more individual dispensing ports 20 may be utilized, and which may or may not have individual valves 24 associated therewith to selectively control the amount and position of mastic being dispensed.

The discharge manifold 18 is interconnected to the frame by a handle mechanism 42 which has a hinge 40 positioned proximate to the wheels 16, and allows the discharge manifold 18 to be selectively raised and lowered by the operator as necessary. As further identified, in FIG. 2, one or more wheels 16 are generally interconnected to a lower portion of the frame 4, and which allows the apparatus to be easily moved from one position to another at a rate of speed determined by the operator Referring now to FIG. 3 and FIG. 4, a front elevation view and a right elevation view of the present invention is provided herein respectively. As depicted, the pneumatic injection line 26 is in communication with a pressure gauge 32, and has a secondary line extending to a container inductor plate 34. The container inductor plate 34 has an exterior diameter which is operably sized to fit the internal diameter of the adhesive container 14, and which provides a sealing mechanism to assure the communication of the roofing mastic material from the adhesive container 14 through the pump 8 and the discharge line to the discharge manifold. To assist in removing the induction plate 34 from the container 14, a valve 24 is closed preventing air intake to the pump 8, and allowing compressed air to be injected into the container 14, which provides an upward force which pushes the inductor plate upward from the container opening. A pressure relief valve 36 is also provided on the inductor plate 34 to release pressure in the container as necessary, and is also opened to allow air to escape as the inductor plate 34 is positioned within the container 14.

Figure 4:
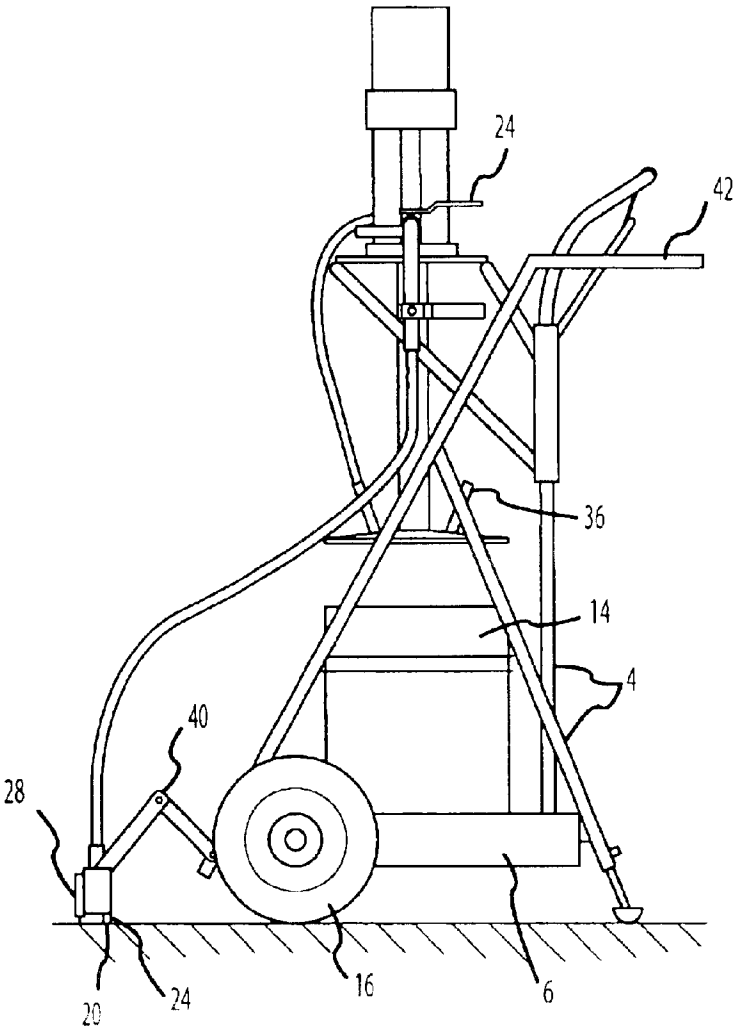
FIG. 4 is a right elevation view of the invention shown in FIG. 1.
Figure 3:
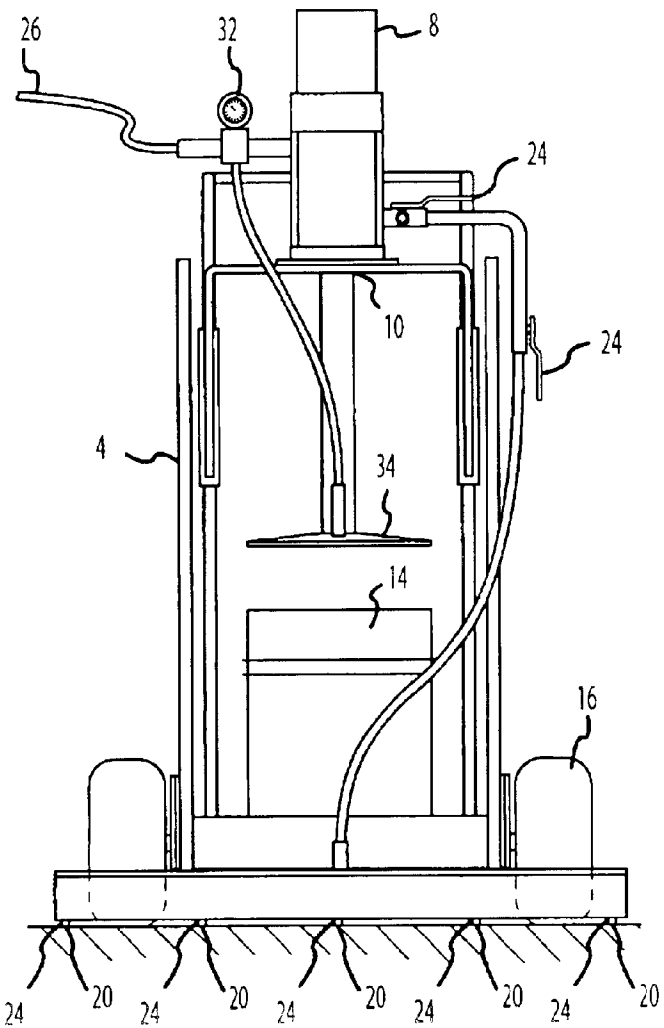
FIG. 3 is a front elevation view of the invention shown in FIG. 1.

As additionally seen in FIG. 4, a hinge mechanism 40 may be provided between the frame 4 and the discharge manifold 18, which can be moved to selectively put the discharge manifold in a downward position as shown, or elevated to allow transportation of the apparatus. Thus, in one embodiment of the present invention, one portion of the frame 4 is used to support the platform 6, wheels 16, pump 8 and other associated componentry, while another portion of the frame 4 is used to selectively raise and lower the discharge manifold 18.

As additionally seen in FIG. 2, in one embodiment of the present invention a spreader mechanism 28 is provided which selectively spreads the adhesive mastic material along a roofing surface as the apparatus is rolled. In an alternative embodiment to the present invention, an oscillating device may be used to oscillate the spreader 28 in a direction substantially parallel to the longitudinal access of the discharge manifold 18 to more effectively and uniformly apply the mastic material to the roofing surface. In one embodiment of the present invention, the spreader 28 is comprised of a rubber material, although other similar materials including fiberglass, metal, and plastic may be used for the same purpose. Alternatively, one or more chains may be used to apply the mastic material in a substantially uniform pattern over a roofing surface.

Figure 5:
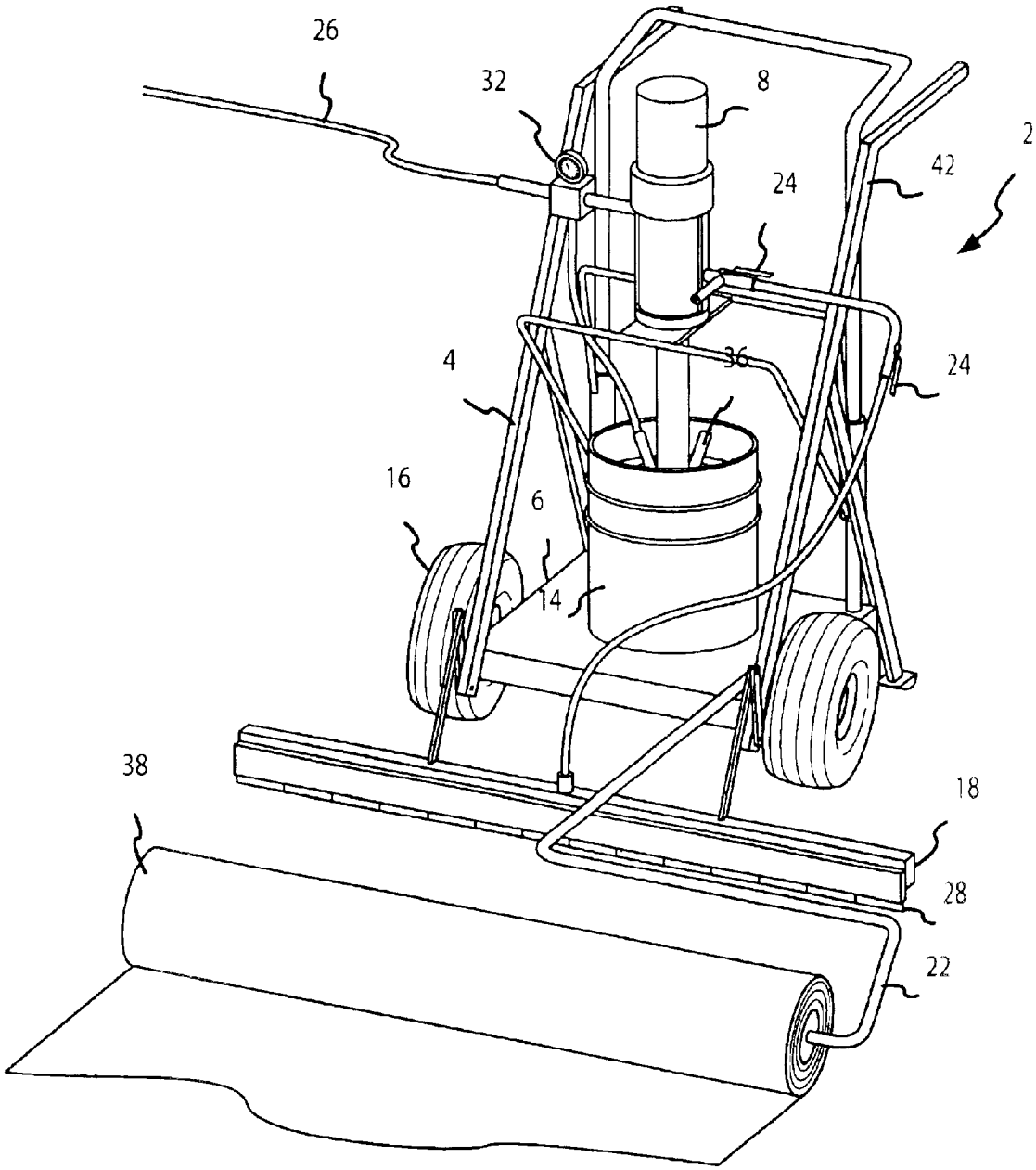
FIG. 5 is a front perspective view of the invention shown in FIG. 1, and further identifying a support member used to hold a roll of bulk roofing material.

Referring now to FIG. 5, another embodiment of the present invention is provided herein. More specifically, a support member 22 is operably interconnected to the frame 4 in a manner which positions the support member 22 immediately downstream of the portable mastic applicator 2. In this embodiment, a roll of bulk roofing material 38 such as felt is removably interconnected to the support member 22, in such a manner which allows the bulk roofing material 38 to unwind and be applied to the roofing surface. Also in this embodiment, the mastic adhesive is applied through the discharge manifold 18 and spread with the spreader 28 or resilient flap or flaps while the bulk roofing material 38 is laid down uniformly on top of the mastic material. Thus, this embodiment allows both the mastic material and roofing material 38 to be applied to the roofing surface simultaneously, and hence saves manpower, time and installment costs. In an alternative embodiment, a bulk granular container 44 (see FIG. 7) may be installed on the support member 22 or associated frame 4, which allows granular material such as mineral granules, gravel, or other materials to be applied to the roofing surface downstream of the discharge manifold 18. Thus, the present invention is adapted for a variety of uses to either independently apply a roofing mastic material, or can be used in combination with bulk roofing materials 38 such as felt or cap sheets, or alternatively with bulk roofing materials such as pea gravel, sand or other materials to a roofing surface. As appreciated by one skilled in the art, the present invention may be used to either independently apply the mastic material, bulk roofing material such as felt or granular material such as gravel, or alternatively may be used to apply two or three materials simultaneously.

Figure 6:
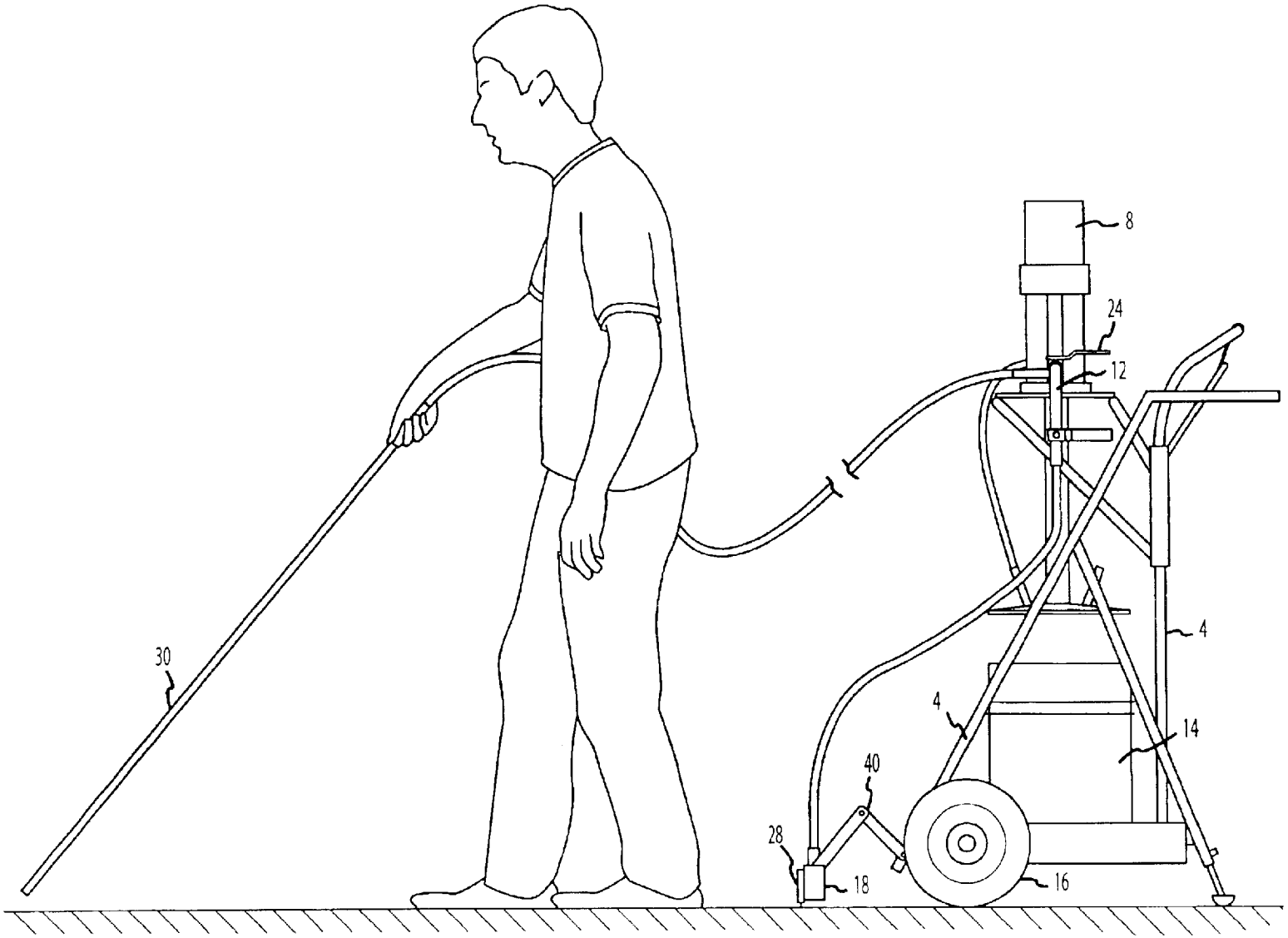
FIG. 6 is a right elevation view of an alternative embodiment of the invention shown in FIG. 1, and identifying the use of a handheld wand for selective application of the adhesive mastic material.

Referring now to FIG. 6, an alternative embodiment of the present invention is provided wherein a handheld wand 30 is provided for use by the operator to selectively apply a single bead or spray of mastic material in a desired location. By closing the valve 24, the flow of adhesive mastic material to the discharge manifold 18 is prevented, while an additional valve 24 is opened, and thus allowing the mastic material to be discharged through the handheld wand 30 in a predetermined location for use along seams, corners, and other hard to reach locations where the adhesive mastic material is required. When not in use, the handheld wand 30 and associated hose may be disconnected from the apparatus or stored in an unobstructed position.

In a further embodiment of the present invention not shown, a self contained motor may be utilized in conjunction with the present invention to allow the apparatus to be self propelled. In this embodiment, a small electric, gas operated, or pneumatic motor may be interconnected to the frame with a gearing mechanism and associated chain or belt to drive the wheels at a predetermined speed as determined by the operator. This feature may allow for a larger sized adhesive container 14 to be used in a range of 10 to 50 gallons, or allow heavier roofing bulk materials 38 to be suspended from the support frame 4 while providing ease of operation and reduced fatigue for the operator. Other embodiments of the present invention employ adhesive containers 14 that hold no more than about 10 gallons of material.

Referring now to FIGS. 8–11, an alternative embodiment of the present invention is shown wherein the adhesive container 14 is capable of movement relative to a fixed induction plate 34. More specifically, this embodiment is equipped with pressure activated pistons 46 which are interconnected to a movable platform 48. Once movement is initiated pressure in the adhesive container 14 is increased and the amount of work required by the pump 8 is dramatically reduced.

Figure 8:
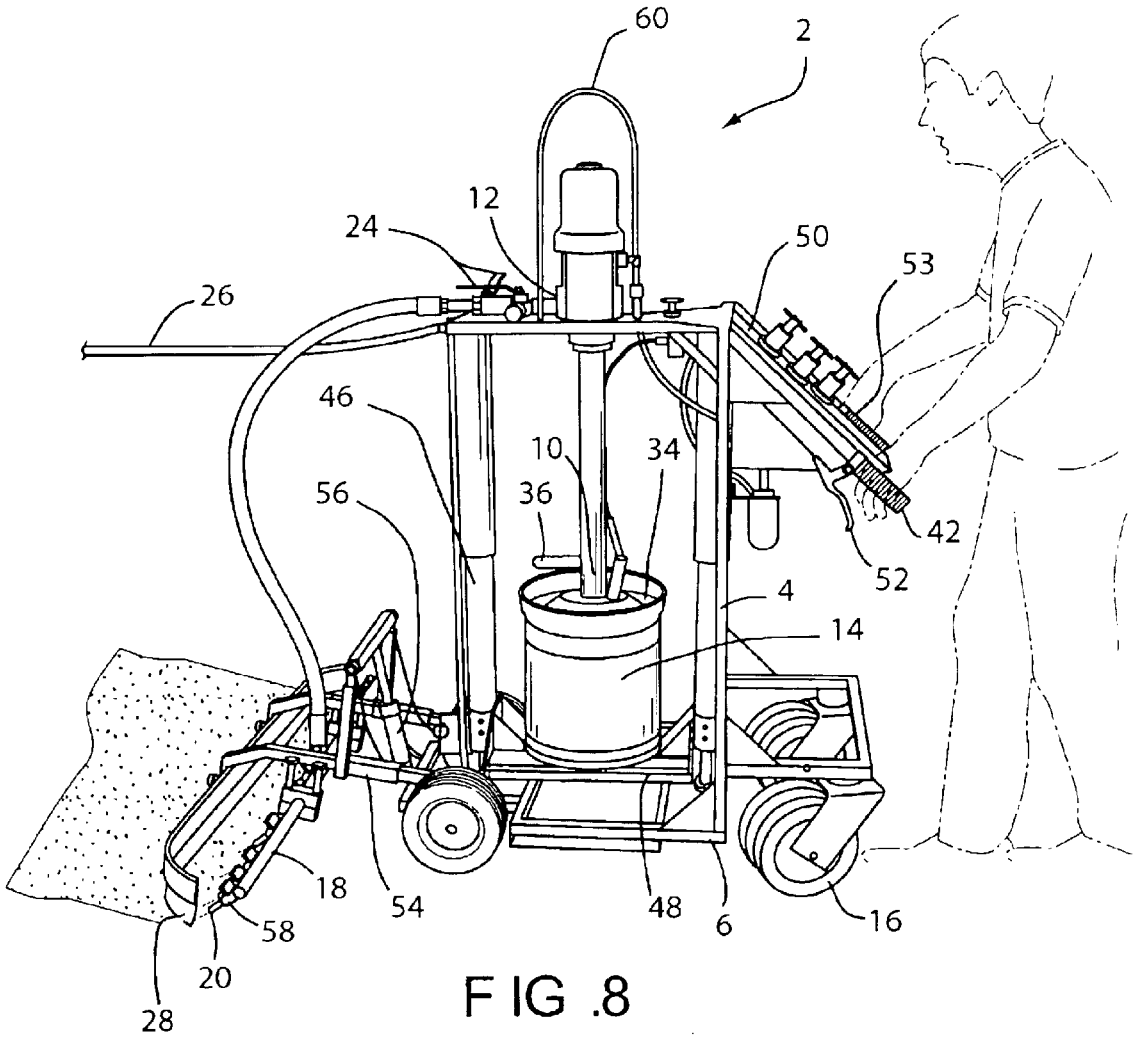
FIG. 8 is a perspective view of another embodiment of the present invention in use.

Referring now to FIG. 8, an adhesive applicator 2 is shown wherein a selectively interconnectable roofing material applicator is omitted. The present invention includes, among other things, a frame 4 wherein wheels 16, a control console 50, user interface 52, a selectively movable discharge manifold 18, and a selectively movable platform 48 are interconnected. Additional container internal pressure is provided by upward motion of the movable platform 48, such that the adhesive contained within the container 14 is compressed and thus aiding the pump 8. Therefore, the pump 8 required to perform the task could be reduced in size and performance which reduces total system weight and cost. For example, one embodiment of the present invention employs a 5:1 ratio Fire-Ball® pump distributed by Graco®, which is smaller than the 45:1 ratio pumps used to spray viscous mastic adhesive in alternative embodiments of the present invention. Although, a positive displacement type pump is preferred, one skilled in the art will appreciate that other pump types such as an Archimedes screw, piston, plunger, axial flow, propeller, mixed flow, turbine, Francis Vane, radial vane, or any other pumping mechanism may be used.

In order to provide increased pressure to the adhesive to aid in the pumping process, preferably a plurality of pistons 46 are employed. In one embodiment of the present invention the inner shaft of the piston is interconnected proximate to the lower frame 4 and an outer shaft is operably connected thereto. One skilled in the art will appreciate that the hydraulic pump 8 or means of increasing the internal pressure of the container 14 are not limited to the locations shown and other combinations may be used to achieve the same result. In addition, the movable platform 48 is interconnected to the outer struts such that when pressurized air or fluid is introduced to the pistons 46, the piston length increases thereby imparting upward motion on the movable platform 48 and the adhesive container 14. The resultant pressure increase is similar to that seen generally in syringes wherein a plunger is inserted into a hollow shaft resulting in pressurized fluid emanation. The pressurized adhesive aids the pump and therefore allows the utilization of a smaller and lighter pump 8.

In order to ensure the internal container pressure does not exceed a predetermined maximum, the user is equipped with a number of monitoring and control mechanisms. For example, a number of pressure sensing mechanisms are provided in one embodiment that allow a user to monitor the internal container 14 pressure. Preferably, the internal pressure of the container 14 should be maintained to 65–80 psi. However, certain application materials have various viscosities such that some experimentation maybe needed to provide an optimum result. Alternatively, a container 14 may be provided that is capable of withstanding greater internal pressure wherein a pump would not be required. In addition, the user is equipped with an interface 52 which will enable him or her to control the internal container pressure by selectively regulating the container pressure with the positioning of the platform's 48 pistons 46. The interface may comprise a handle interconnected to the frame, wherein the handle is interconnected to a wire which controls the opening and closing of a valve.

Figure 9:
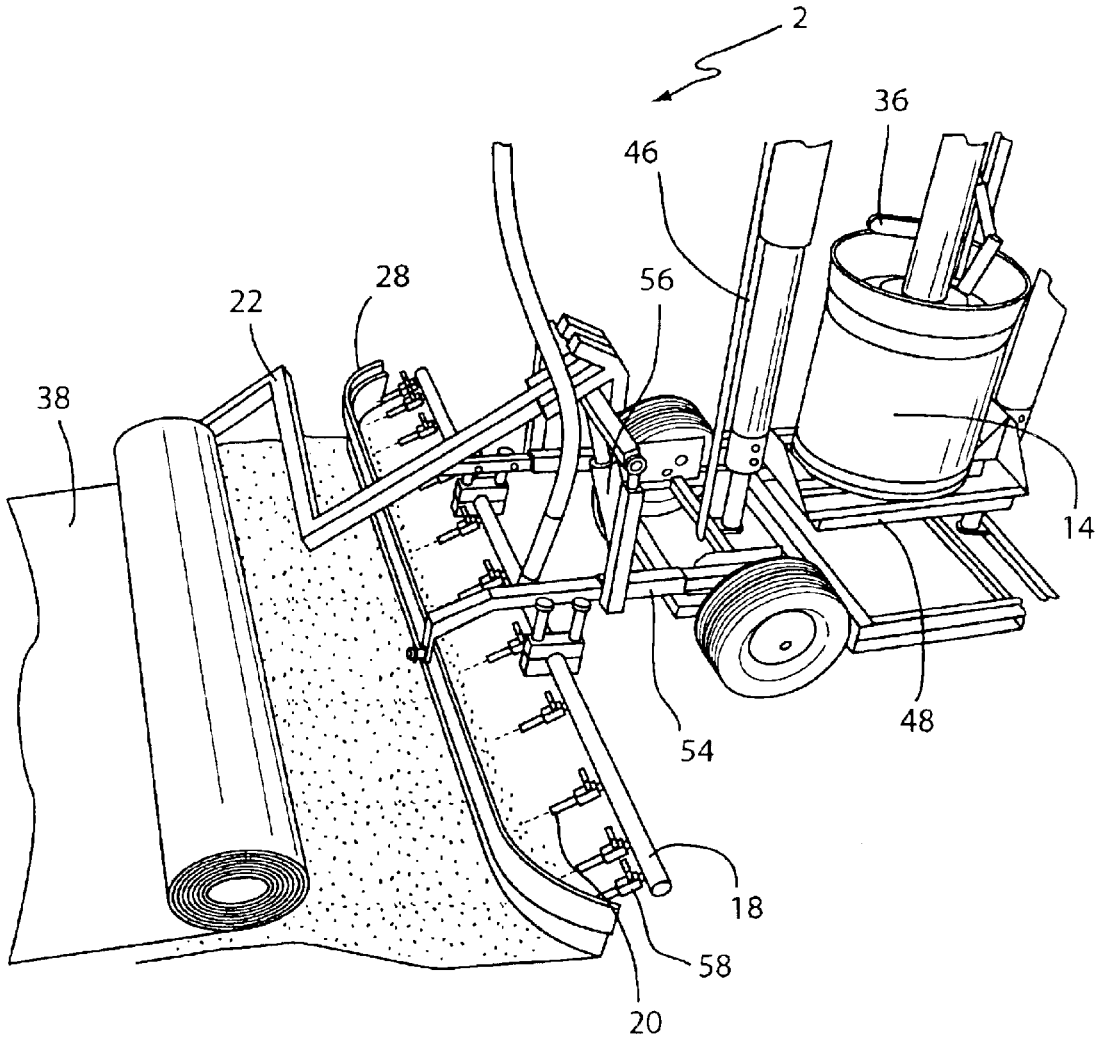
FIG. 9 is a detailed perspective view of the embodiment shown in FIG. 8 which additionally employs a mechanism for unrolling bulk roofing material.
Figure 10:
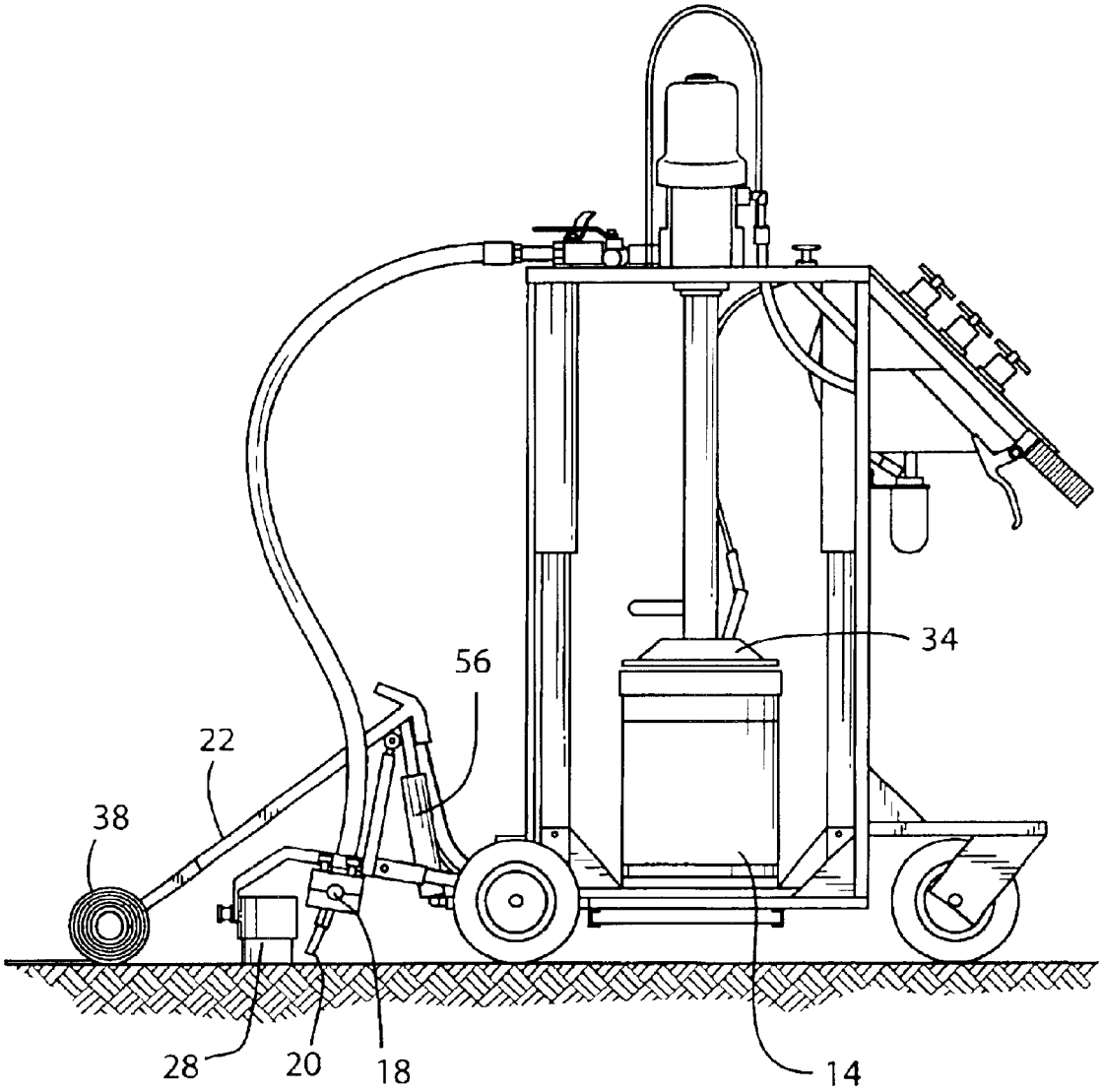
FIG. 10 is a right elevation view of the embodiment shown in FIG. 8, wherein a movable platform is in a first position.
Figure 11:
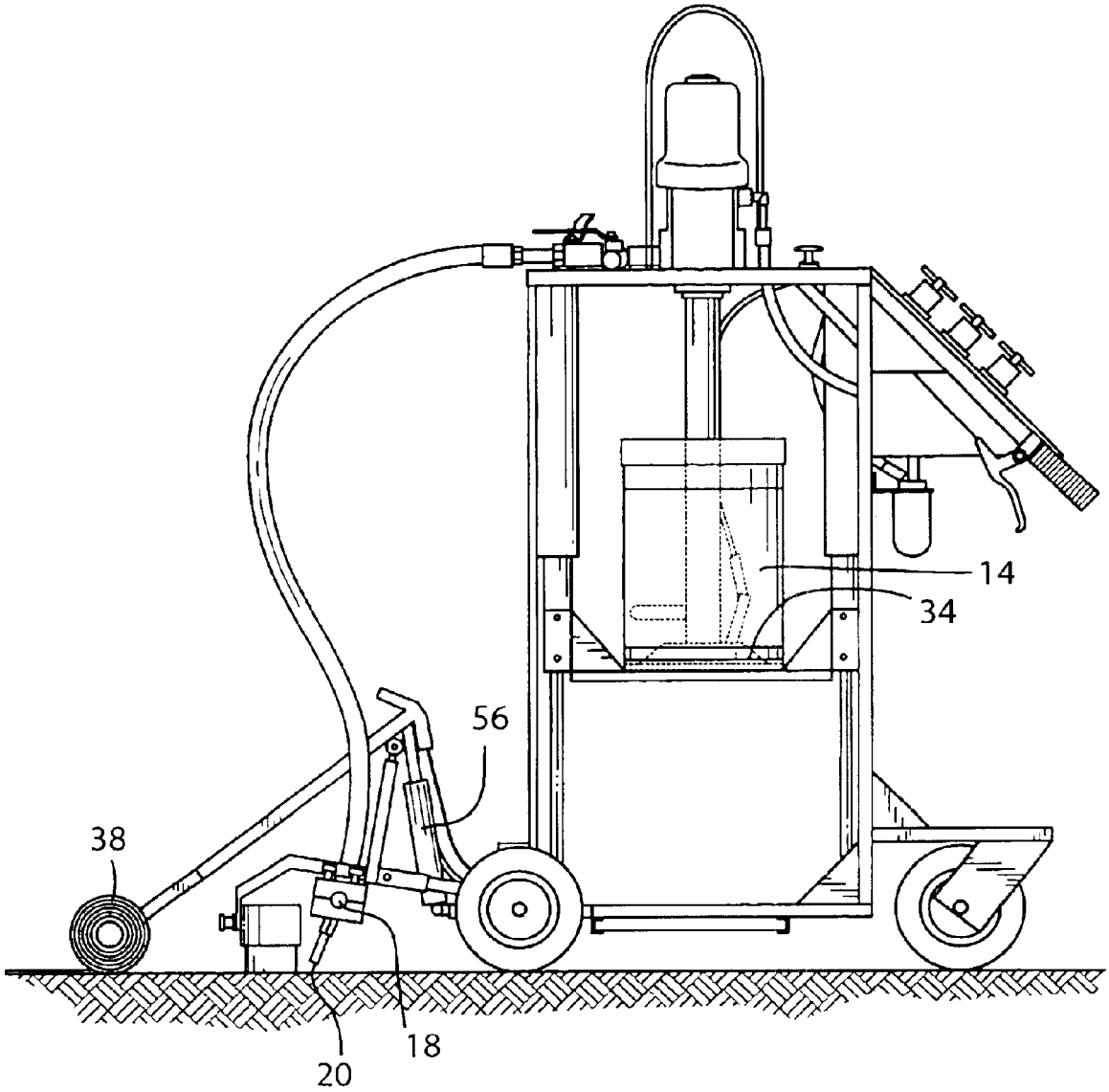
FIG. 11 is a right elevation view of the embodiment shown in FIG. 8, wherein a movable platform is in a second position.

Referring now to FIG. 9, a detailed view of the adhesive application mechanism is shown herein which is additionally equipped with a mechanism to distribute bulk roofing material 38. One embodiment of the present invention is equipped with a discharge manifold 18 interconnected to a component engagement mechanism 54 which is hingedly connected to the frame 4. In addition, depending on the desired application effect, a spreading mechanism and/or a bulk material 38 layer can be employed on said engagement mechanism 54. The engagement and degree thereof of any of the above-mentioned mechanism is controlled by an additional piston 56 wherein pressurized air or fluid initiates extension and retraction. Preferably, an additional user interface 50 is provided wherein activation causes pressurized air to extend the piston 56, thereby forcing rotation of the engagement mechanism 54 about its hinged connection which would engage, for example, the discharge ports 20 and the spreading mechanism 28 to their application positions. Conversely, the user is capable of raising the engagement mechanism 54 by removing pressure from the piston 56, thereby initiating opposite rotation. When used with a spreading mechanism 28, the user will be able to monitor the relative thickness of the applied material by monitoring the pressure on the piston 56 and the spreader mechanism 28. For example, the more pressure in the piston 56 the greater the contact between the spreader mechanism 28 and the application surface, therefore a thinner adhesive layer will be applied.

The discharge manifold 18 of one embodiment of the present invention is equipped with a plurality of discharge ports 20. Preferably, these ports 20 are capable of selective activation and deactivation by the incorporation of valves 58. Thus, the user is capable of varying the width of the application area or the location of individual adhesive streams. This aspect of the present invention will aid in the reduction of material costs by alleviating the use of un-needed materials.

Figure 7:
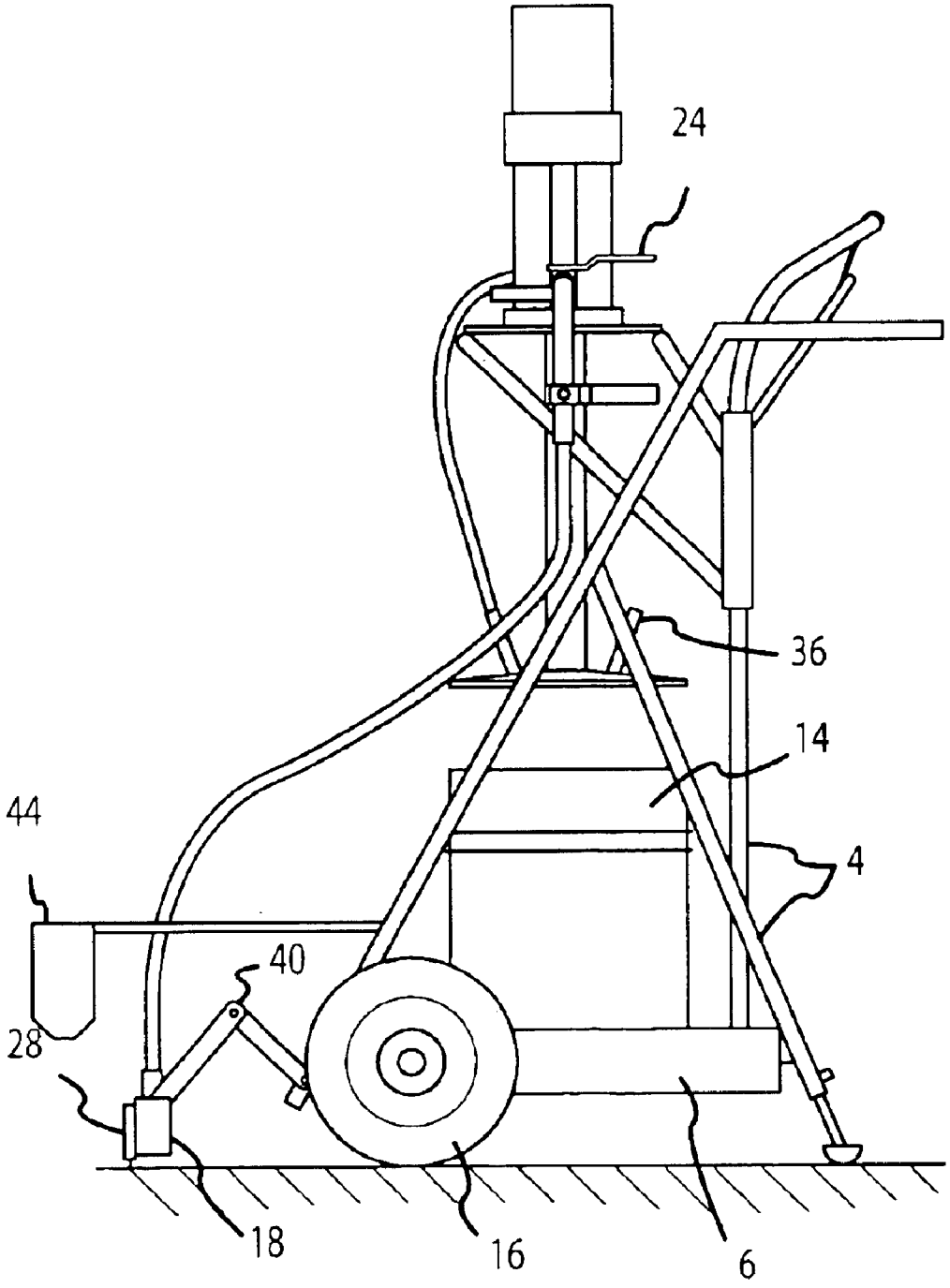
FIG. 7 is a right elevation view of the embodiment shown in FIG. 4, and further including a container and spreader for granular material.

It should be noted that additional attachments as shown in FIGS. 6–7 are equally applicable in this alternate embodiment of the present invention. More specifically, the wand 30 and the general material container 44 can be employed depending on the needs of a particular task.

Referring again to FIGS. 8–11, a detailed description of the method of use of one embodiment follows hereinbelow. Upon arriving at a job site a laborer hoists the portable mastic applicator 2 onto the roof by preferably attaching a lifting mechanism to a lifting fixture 60 provided on the applicator 2. Due to the reduction in pump size and capability of selectively interconnecting various subcomponents, this task may be accomplished with a simple hoisting mechanism. Next, the pressurized air source is hoisted to the roof or alternatively a pressure line is run to the work area. Next, the pressurized air line 26 is connected to an intake port of the applicator 2. The application material, for example mastic adhesive, is placed on the movable platform 48 in a container under the inductor plate 34, such that when engagement occurs there will be a sufficient seal between the inductor plate 34 and the adhesive container 14. The moving platform pistons 46 are then pressurized to a predetermined amount to slowly raise the container 14 so that minute mating adjustments can be performed. Once said initial mating occurs, a pressure regulation valve 36 on the inductor plate 34 is opened so that entrapped air is able to escape so that the pump head 10 will not cavitate. Then the movable platform 48 is again lifted to force the trapped air to bleed out of the container 14. At a predetermined time the valve 36 is closed so that any additional platform 48 movement will result in a proportional internal pressure increase. The container internal pressure is continually monitored 50 such that the user releases the movable platform controller 52 preferably when the container's 14 internal pressure reaches approximately 65–80 psi. Next, the applicator is positioned in a predetermined location on the roof, a valve is activated that controls the engagement mechanism piston 56, and user-initiated pressurized air is directed to the piston 56 such that the discharge manifold 18, and if required, the spreading mechanism 28 is positioned for adhesive application. Additionally, the bulk roll 38 of roofing material may also be interconnected to the applicator 2 if required. The pump 8 is now engaged and valves are tailored to achieve the desired flow condition. Finally, the applicator 2 is pulled so that a layer of adhesive is deposited as required. When the end of the roof is reached the user releases the platform pressure control 52 (thereby stopping upward motion of the platform 48), releases the engagement piston user interface 53

(thereby lifting the engagement mechanism 54),and reduces pump 8 suction in order to turn the applicator 2 around and repeat the spreading process.

Once substantially all of the adhesive is removed from the container 14 it must be replaced, or alternatively refilled. Container 14 exchange is aided by adding pressurized air while lowering the movable platform 48 in order to disengage the inductor plate 34, wherein subsequent containers 14 of adhesive are added as required. Alternatively, a refillable container may be employed wherein it would be refilled after the inductor plate is disengaged. After the job is completed, the applicator 2 is hoisted back down and cleaned. One skilled in the art will appreciate that the above listed steps are not exclusive and are in no required order.

To provide clarity to the present invention, a detailed list of the following components and the associated numbering therein is provided for reference purposes.

COMPONENT

2 Portable Mastic Applicator
4 Frame
6 Platform
8 Pump
10 Pump Suction End
12 Pump Discharge End
14 Adhesive Container
16 Wheels
18 Discharge Manifold
20 Dispensing Port
22 Support Member
24 Valve
26 Pneumatic Injection Line
28 Spreader Mechanism
30 Handheld Wand
32 Pressure Gauge
34 Container Inductor Plate
36 Pressure Relief Valve
38 Bulk Roofing Material
40 Hinge
42 Handle Mechanism
44 Granular Material Container
46 Movable Platform Pistons
48 Movable Platform
50 Control/Monitoring Console
52 Pump/Movable Platform Control
53 Engagement Mechanism Control
54 Component Engagement Mechanism
56 Engagement Piston
58 Discharge Valve
60 Lifting Fixture While various embodiments of the present invention have been described in detail, it is apparent that modifications and adaptations of those embodiments will occur to those skilled in the art. However, it is to be expressly understood that such modifications and adaptations are within the spirit and scope of the present invention, as set forth in the following claims.

What is claimed is:

1. An apparatus adapted for applying a liquid material, comprising:

a frame;

at least one wheel rotatably interconnected to said frame;

a platform interconnected to said frame which is adapted for supporting a container of the liquid material;

a pump interconnected to said frame and comprising a suction end and a discharge end, said suction end operably positioned to communicate with the liquid material;

a container induction plate interconnected proximate to said suction end of said pump for sealingly engaging an open end of the container;

a discharge manifold in operable communication with said discharge end of said pump;

at least one dispensing port in communication with said discharge manifold for discharging the liquid material onto a treatment surface; and a platform lifting means, wherein said platform travels between a first lowered position and a second raised position while said inductor plate is maintained in a substantially static position, wherein a pressure is applied to the liquid material in the container.

2. The apparatus of claim 1, wherein said platform lifting means comprises a pneumatic piston assembly operably interconnected to said frame, and said platform.

3. The apparatus of claim 1, wherein said platform lifting means imparts at least 40 psi of pressure to said liquid material in the container.

4. The apparatus of claim 1, wherein said platform lifting means travels at least about 18 to 24 inches between said first lowered position and said second raised position.

5. The apparatus of claim 1, wherein said platform lifting means reduces a required pump ratio of said pump by at least about 50 percent.

6. The apparatus of claim 5, further comprising a pneumatically controlled spreader mechanism which is adapted to spread and control the thickness of said liquid material on the treatment surface, said pneumatically controlled spreader mechanism capable of traveling between a plurality of positions above the treatment surface.

7. The apparatus of claim 1, wherein said pump is capable of pumping the liquid material at a rate of at least about 3 (three) gallons per minute when the liquid material has a viscosity of at least about 100,000 centipoise at an ambient temperature of about 50° F.

8. The apparatus of claim 1, wherein the container is a five gallon pail.

9. The apparatus of claim 1, further comprising a hand controlled interface means for selectively raising and lowering said platform lifting means.

10. The apparatus of claim 9, wherein said hand controlled interface means comprises a handle interconnected to said frame, wherein said handle is interconnected to a wire which controls the opening and closing of a valve.

11. The apparatus of claim 1, wherein said pump is operated with compressed air.

12. The apparatus of claim 1, further comprising a relief valve on said inductor plate, wherein pressure within the container may be selectively released.

13. The apparatus of claim 1, further comprising an air intake valve operably interconnected to said inductor plate, wherein a pressure can be applied within the container to assist in removing said inductor plate from said open end of the container.

14. A combination of a portable container for holding a viscous liquid and an apparatus adapted for applying the viscous liquid to a surface, comprising:

a portable container adapted for holding the viscous liquid;

a frame having at least one wheel rotatably interconnected to said frame;

a platform interconnected to said frame to operably support said portable container;

a pump mechanism operably engaged to said frame and comprising a suction end and a discharge end, said suction end in operable communication with said portable container;

a container inductor plate interconnected to said suction end of said pump mechanism for sealingly engaging an open end of said portable container;

a manifold interconnected to said frame and in operable communication with said discharge end of said pump;

at least one dispensing port in operable communication with said manifold for discharging the viscous liquid on the surface; and a liquid pressure enhancement means operably interconnected to said frame, wherein the internal pressure in the portable container may be selectively increased to improve the efficiency of said pump mechanism.

15. The combination of claim 14, wherein said portable container holds no more than about 10 gallons.

16. The combination of claim 14, wherein said liquid pressure enhancement means comprises a pneumatic lift operably interconnected to said platform, wherein said platform selectively travels between a first position of substantially non-compression of said fluid and a second position of compression of said liquid.

17. The combination of claim 14, wherein said liquid pressure enhancement means creates an internal pressure in said container of at least about 20 psig.

18. The combination of claim 14, further comprising a pneumatic spreader mechanism operably interconnected to said frame which may be selectively lowered and raised with respect to the surface for spreading the liquid.

19. The combination of claim 14, further comprising a hand operated controller interconnected to said frame for operating said liquid pressure enhancement means.

20. The combination of claim 14, further comprising a support member interconnected to said frame which is adapted for holding a roll of roofing material in a downstream position from said manifold, wherein the roofing material can be applied over the viscous liquid while the apparatus is being moved along a roofing surface.

21. The combination of claim 14, wherein said pump mechanism operates with compressed air.

22. The combination of claim 14, further comprising a pressure relief valve operably interconnected to said container inductor plate for selectively reducing the pressure in said container.

23. The combination of claim 14, further comprising an air intake valve operably interconnected to said container inductor plate, wherein a compressed air may be introduced into said container to facilitate removal of said container inductor plate from said container.

24. A portable apparatus adapted for applying a liquid material to a surface, comprising a frame;

at least one wheel rotatably interconnected to said frame to facilitate movement of said portable apparatus;

a platform interconnected to said frame which is adapted to support a container of the liquid material, said platform selectively moveable between a first position and a second position;

a pump operably interconnected to said frame and comprising a suction end and a discharge end, said suction end positioned to communicate with the liquid material in the container;

a container inductor plate sealingly engaged to an open end of said container;

a discharge manifold in operable communication with said discharge end of said pump, said discharge manifold in communication with at least one discharge port for discharging said liquid material; and a platform lift operably interconnected to said platform which is powered by at least one of a pneumatic, a hydraulic and electric energy source, and which imparts motion in said platform to selectively increase a pressure of the liquid material in the container.

25. The apparatus of claim 1 wherein said discharge manifold may be selectively adjusted to a plurality of positions.

* * * * *